US008408024B2

(12) United States Patent
Ogata et al.

(10) Patent No.: US 8,408,024 B2
(45) Date of Patent: Apr. 2, 2013

(54) FLUID MACHINE AND REFRIGERATION CYCLE APPARATUS

(75) Inventors: Takeshi Ogata, Osaka (JP); Hiroshi Hasegawa, Osaka (JP); Masanobu Wada, Osaka (JP); Yu Shiotani, Osaka (JP); Subaru Matsumoto, Osaka (JP)

(73) Assignee: Panasonic Corporation, Osaka (JP)

( * ) Notice: Subject to any disclaimer, the term of this patent is extended or adjusted under 35 U.S.C. 154(b) by 718 days.

(21) Appl. No.: 12/670,213

(22) PCT Filed: Apr. 14, 2009

(86) PCT No.: PCT/JP2009/001706

§ 371 (c)(1),
(2), (4) Date: Jan. 22, 2010

(87) PCT Pub. No.: WO2009/141956

PCT Pub. Date: Nov. 26, 2009

(65) Prior Publication Data

US 2010/0186439 A1 Jul. 29, 2010

(30) Foreign Application Priority Data

May 23, 2008 (JP) ..... 2008-135791

(51) Int. Cl.
*F25D 9/00* (2006.01)

(52) U.S. Cl. ..... 62/402; 62/468

(58) Field of Classification Search ..... 60/456; 62/87, 468, 469, 501, 510; 417/374; 418/55.6
See application file for complete search history.

(56) References Cited

U.S. PATENT DOCUMENTS

| | | | | |
|---|---|---|---|---|
| 4,277,955 | A | 7/1981 | Parker | |
| 4,383,802 | A | 5/1983 | Gianni et al. | |
| 2005/0183447 | A1 * | 8/2005 | Matsumoto et al. | 62/470 |
| 2006/0059929 | A1 | 3/2006 | Sakitani et al. | |
| 2007/0074534 | A1 * | 4/2007 | Sato | 62/468 |
| 2008/0163642 | A1 | 7/2008 | Okamoto et al. | |
| 2009/0064709 | A1 | 3/2009 | Sekiya et al. | |
| 2009/0139262 | A1 | 6/2009 | Takahashi et al. | |

FOREIGN PATENT DOCUMENTS

| | | | |
|---|---|---|---|
| JP | 1-127865 | A | 5/1989 |
| JP | 6-046261 | U | 6/1994 |
| JP | 7-035045 | | 2/1995 |
| JP | 2004-212006 | A | 7/2004 |

(Continued)

OTHER PUBLICATIONS

Specification, Claims, Abstract & Drawings from co-pending matter U.S. Appl. No. 12/670,231, filed Jan. 22, 2010, 27 pages.

*Primary Examiner* — Melvin Jones
(74) *Attorney, Agent, or Firm* — Hamre, Schumann, Mueller & Larson, P.C.

(57) ABSTRACT

There may be a case where, by simply coupling the first compressor (expander compressor unit) and the second compressor with an oil-equalizing pipe, the first compressor is not lubricated sufficiently, thereby decreasing reliability. The volumetric capacity (V1) of the first available oil space (130) of the first compressor (101) is set larger than the volumetric capacity (V2) of the second available oil space (140) of the second compressor (102). With this configuration, even if the oil level (S1) of the first oil sump (13) decreases in transition to a state of steady operation, it is possible to maintain a sufficient amount of oil in the first compressor (101), and thus high reliability as a fluid machine can be achieved.

12 Claims, 10 Drawing Sheets

FOREIGN PATENT DOCUMENTS

| | | | |
|---|---|---|---|
| JP | 2007-170765 | A | 7/2007 |
| JP | 2008-038915 | | 2/2008 |
| JP | 2008-107049 | | 5/2008 |
| JP | 2008-116153 | A | 5/2008 |
| WO | WO 2006/098165 | A1 | 9/2006 |

* cited by examiner

FLUID MACHINE AND REFRIGERATION CYCLE APPARATUS

TECHNICAL FIELD

The present invention relates to a fluid machine and a refrigeration cycle apparatus using the same to be used for a water heater, air-conditioner or the like.

BACKGROUND ART

Recently, for the purpose of further improving the efficiency of a refrigeration cycle apparatus, there is proposed a power-recovery type refrigeration cycle apparatus using an expansion mechanism instead of an expansion valve in which the expansion mechanism recovers the pressure energy as power in the course of the expansion of a refrigerant (working fluid), thereby reducing the electric power required for driving a compression mechanism by the amount of the power recovered. Such a refrigeration cycle apparatus uses an expander compressor unit in which a motor, a compression mechanism and an expansion mechanism are coupled by a shaft.

In the expander compressor unit, the compression mechanism and the expansion mechanism are coupled by the shaft, and therefore there may be a case where the displacement of the compression mechanism is insufficient, or the displacement of the expansion mechanism is insufficient, depending on the operational conditions. In order to ensure recovery power even under operational conditions where the displacement of the compression mechanism is insufficient so that the COP (Coefficient of Performance) of the refrigeration cycle apparatus can be kept high, there also is proposed a refrigeration cycle apparatus using a secondary compressor in addition to an expander compressor unit (see, for example, Patent literature 1). In this refrigeration cycle apparatus, the secondary compressor is operated so that the high pressure in a refrigeration cycle should be a specified target value.

FIG. 8 is a configuration diagram indicating a refrigeration cycle apparatus described in Patent literature 1. As indicated in FIG. 8, the refrigeration cycle apparatus using an expander compressor unit 220 and a second compressor 230 includes a refrigerant circuit 210 and a controller 250 as a control device. In the refrigerant circuit 210, a first compression mechanism 221 of the expander compressor unit 220 and a second compression mechanism 231 of the second compressor 230 are disposed in parallel between an indoor heat exchanger 211 and an outdoor heat exchanger 212. Further, the first compression mechanism 221 is coupled with a motor 222 and an expansion mechanism 223 by a shaft, and the second compression mechanism 231 is coupled with a motor 232 by a shaft.

The controller 250 controls the second compressor 230 so that the high pressure in a refrigeration cycle should be a specified target value. Specifically, if the measured value of the high pressure Ph is higher than the target value, the controller 250 reduces the discharge amount from the second compression mechanism 231 by decreasing the rotation speed of the motor 232, and if the measured value of the high pressure Ph is lower than the target value conversely, it increases the discharge amount from the second compression mechanism 231 by increasing the rotation speed of the motor 232.

Accordingly, even under operational conditions where the displacement only of the first compression mechanism 221 is insufficient, it is possible to compensate for the shortage of the displacement by driving the second compression mechanism 231. Thus, the operation of the refrigeration cycle apparatus can be continued with a high COP.

Meanwhile, for higher output of a refrigeration cycle apparatus, there also is a refrigeration cycle apparatus using a plurality of compressors. For example, Patent literature 2 discloses a refrigeration cycle apparatus as indicated in FIG. 9. This refrigeration cycle apparatus includes a refrigerant circuit 310 in which two compressors 320 and 330 are disposed in parallel. Oil to be used for lubricating and sealing the sliding portions of the compression mechanism is stored inside the compressors 320 and 330. Such a refrigeration cycle apparatus has problems in the context of reliability and efficiency if the amount of the oil stored in each of the compressors 320 and 330 is unbalanced. To solve the problems, the refrigeration cycle apparatus disclosed in Patent literature 2 employs a structure for balancing the amount of oil to be stored in the two compressors 320 and 330.

That is, as indicated in FIG. 9, pipes on the refrigerant-discharge side of the compressors 320 and 330 each are provided with an oil separator 311 and an oil-bypass pipe 312 extending from the oil separator 311 to each pipe on the refrigerant-suction side of the compressors 320 and 330. Further, as indicated in FIG. 10, the lower portions of the compressors 320 and 330 are coupled to each other by an oil-equalizing pipe 350, allowing oil to flow between the compressors 320 and 330 through the oil-equalizing pipe 350. Further, a pipe on the high-pressure side of the refrigeration cycle is provided with a pressure sensor 315.

During operation of the two compressors 320 and 330, the following operation is carried out as an oil-equalizing operation.

First, the operation frequency of the one compressor 320 is stepped up by a particular value, and the operation frequency of the other compressor 330 is decreased until a set time ta has elapsed so that the pressure Pd detected by the pressure sensor 315 does not vary. After the set time ta has elapsed, the operation frequency of the one compressor 320 is stepped down by a particular value, and the operation frequency of the other compressor 330 is increased until a set time ta has elapsed in the same manner so that the pressure Pd detected by the pressure sensor 315 does not vary. Then, after the set time ta has elapsed again, the operation frequency of the compressors 320 and 330 is returned. After every passage of the set time period tb, the above-mentioned oil-equalizing operations of step up and step down are repeated.

Thus, by coupling the compressors 320 and 330 using the oil-equalizing pipe 350 as well as varying the operation frequency of the compressors 320 and 330 alternately during operation of the two compressors 320 and 330, the oil of the compressors 320 and 330 is allowed to flow through the oil-equalizing pipe 350 efficiently, so that the amount of oil to be stored in each of the compressors 320 and 330 is balanced.

CITATION LIST

Patent Literature

Patent literature 1: JP 2004-212006 A
Patent literature 2: JP 1(1989)-127865 A

SUMMARY OF INVENTION

Technical Problem

However, even when trying to balance the amount of oil by coupling the expander compressor unit 230 and the second compressor 230 to each other using an oil-equalizing pipe in the power-recovery type refrigeration cycle apparatus of Patent literature 1 indicated in FIG. 8 and performing an oil-equalizing operation as described in Patent literature 2, a sufficient oil-equalizing effect cannot be achieved because the first compressor 220 and the second compressor 230 are unsymmetrical fluid machines. That is, compared to the second compressor 230 in which the second compression mechanism 231 is a single rotation machine, the expander compressor unit 220 includes the expansion mechanism 223 in addition to the first compression mechanism 221 and therefore a large amount of oil is used therein. For this reason, even if the operation frequency is varied alternately at every particular time period, the amount of oil to be stored inside the first compressor 220 decreases, which may result in an insufficient supply of oil to the sliding portions of the compression mechanism or the expansion mechanism. As a result, the reliability decreases.

The present invention has been devised in view of the problem described above, and an object thereof is to provide a fluid machine of high reliability including an expansion mechanism and compression mechanisms.

Solution to Problem

In order to achieve the objects, the present invention provides a fluid machine including: a first closed casing including a first oil sump formed in its bottom and an internal space filled with a working fluid above the first oil sump; a first motor disposed inside the first closed casing; a first compression mechanism disposed inside the first closed casing for compressing the working fluid; an expansion mechanism disposed inside the first closed casing for recovering power from the expanding working fluid; a first shaft coupling the first motor, the first compression mechanism and the expansion mechanism; a first oil pump for drawing the oil of the first oil sump through a first oil-suction opening and supplying the oil to one or both of the first compression mechanism and the expansion mechanism through a first oil-supply passage that is provided in the first shaft and extends above the first oil sump; a first suppressing member disposed so as to horizontally partition the space inside the first closed casing, for preventing the oil of the first oil sump from flowing with the flow of the working fluid inside the first closed casing; a second closed casing including a second oil sump formed in its bottom and an internal space filled with a working fluid above the first oil sump; a second motor disposed inside the second closed casing; a second compression mechanism disposed inside the second closed casing for compressing the working fluid, the second compression mechanism being connected in parallel with the first compression mechanism in a working fluid circuit by interconnection between the first closed casing and the second closed casing through a pipe; a second shaft coupling the second motor and the second compression mechanism; a second oil pump for drawing the oil of the second oil sump through a second oil-suction opening and supplying it to the second compression mechanism through a second oil-supply passage provided in the second shaft; and a second suppressing member disposed so as to horizontally partition the space inside the second closed casing, for preventing the oil of the second oil sump from flowing with the flow of the working fluid inside the second closed casing, wherein a volumetric capacity of a first available oil space from the first suppressing member to the first oil-suction opening inside the first closed casing is set larger than a volumetric capacity of a second available oil space from the second suppressing member to the second oil-suction opening inside the second closed casing.

Further, the present invention provides a refrigeration cycle apparatus including a working fluid circuit integrated with the above-mentioned fluid machine, in which the first compression mechanism and the second compression mechanism are disposed in parallel in the working fluid circuit and the working fluid circuit is filled with carbon dioxide as a working fluid.

ADVANTAGEOUS EFFECTS OF INVENTION

According to the above-mentioned configuration, the volumetric capacity of the first available oil space is set larger than the volumetric capacity of the second available oil space, and thus a sufficient amount of oil can be maintained above the first oil-suction opening. For this reason, even if both compressors are in operation and the oil level of the first oil sump decreases, it is possible to supply the oil of the first oil sump sufficiently to the compression mechanism or the expansion mechanism using the first oil pump. Thus, according to the present invention, a fluid machine with high reliability is achieved.

DESCRIPTION OF EMBODIMENTS

Hereinafter, the embodiments of the present invention is described with reference to the drawings.

First Embodiment

Figure 1:
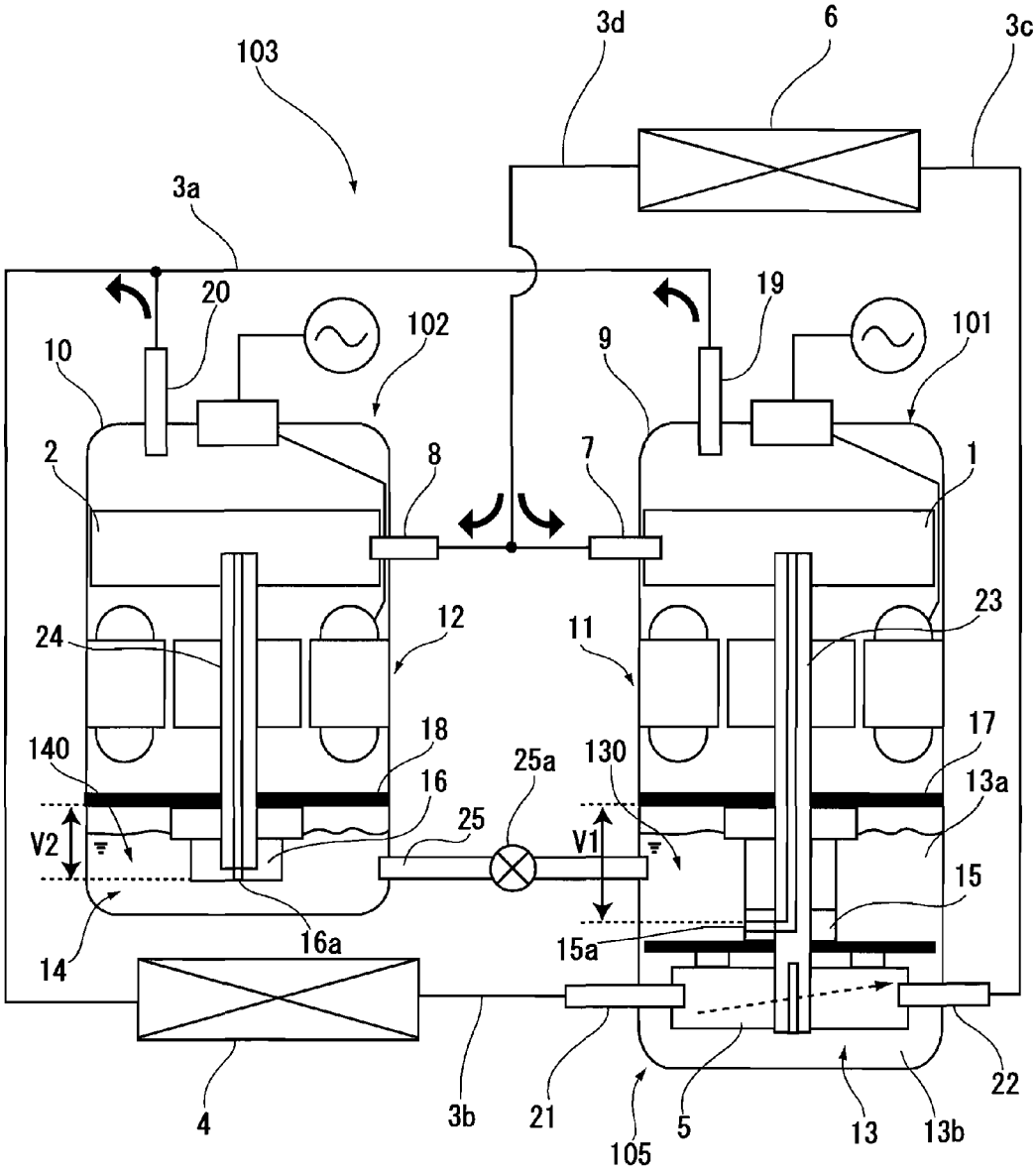
FIG. 1 is a schematic diagram indicating a refrigeration cycle apparatus using a fluid machine according to a first embodiment of the present invention.

FIG. 1 indicates a refrigeration cycle apparatus using a fluid machine 105 according to a first embodiment of the present invention. The refrigeration cycle apparatus includes a refrigerant circuit (working fluid circuit) 103 integrated with the fluid machine 105. The refrigerant circuit 103 includes a first compressor (expander compressor unit) 101, a second compressor 102, a heat radiator 4, an evaporator 6 and first to fourth pipes (refrigerant pipes) 3*a* to 3*d* for connecting these equipments. In this embodiment, the first compressor 101 and the second compressor 102 are coupled to each other by an oil-equalizing pipe 25, and the first compressor 101, the second compressor 102 and the oil-equalizing pipe 25 constitute the fluid machine 105.

Specifically, the first discharge pipe 19 of the first compressor 101 and the second discharge pipe 20 of the second compressor 102 are connected to the heat radiator 4 via the first pipe 3*a* having two branch pipes and a main pipe leading therefrom. The heat radiator 4 is connected to a suction pipe 21 on the expansion side of the first compressor 101 via the second pipe 3*b*. A discharge pipe 22 on the expansion side of the first compressor 101 is connected to the evaporator 6 via the third pipe 3*c*. The evaporator 6 is connected to the first suction pipe 7 of the first compressor 101 and the second suction pipe 8 of the second compressor 102 via the fourth pipe 3*d* having a main pipe and two branch pipes leading therefrom.

The first compressor 101 includes a first closed casing 9 accommodating a first compression mechanism 1, a first motor 11 and an expansion mechanism 5 that are coupled to each other by a first shaft 23. The second compression mechanism 102 includes a second closed casing 10 accommodating a second compression mechanism 2 and a second motor 12 that are coupled to each other by a second shaft 24. The working fluid (refrigerant) that has been compressed in the first compression mechanism 1 and the working fluid that has been compressed in the second compression mechanism 2 are discharged respectively to the outside of the first closed casing 9 and the second closed casing 10 through the first discharge pipe 19 and the second discharge pipe 20. The working fluid discharged to the outside of the first closed casing 9 and the working fluid discharged to the outside of the second closed casing 10 merge in the course of flowing through the first pipe 3*a* so as to be introduced to the expansion mechanism 5 after radiating heat in the heat radiator 4. The working fluid introduced to the expansion mechanism 5 expands there. At this time, the expansion mechanism 5 recovers power from the expanding working fluid. The expanded working fluid flows separately in the course of flowing through the fourth pipe 3*d* after absorbing heat in the heat absorber 6 so as to be introduced to the first compression mechanism 1 and the second compression mechanism 2. That is, the first compression mechanism 1 and the second compression mechanism 2 are disposed in parallel in the refrigerant circuit 103 by interconnection between the first closed casing 9 and the second closed casing 10 through the first pipe 3*a* and the fourth pipe 3*d*. In other words, the first compression mechanism 1 is connected in parallel with the second compression mechanism 2 in the refrigerant circuit 103.

The refrigerant circuit 103 is filled with a working fluid that turns into a supercritical state in a high pressure part (part extending from the first compression mechanism 1 and the second compression mechanism 2 through the heat radiator 4 to the expansion mechanism 5). In this embodiment, the refrigerant circuit 103 is filled with carbon dioxide ($CO_2$) as such a working fluid. However, the kind of the working fluid is not specifically limited thereto. The working fluid may be a working fluid that does not turn into a supercritical state in operation (for example, a fluorocarbon working fluid).

Further, the refrigerant circuit 103 integrated with the fluid machine of the present invention is not limited to the refrigerant circuit in which the working fluid is allowed to flow in one direction. The fluid machine of the present invention may be provided in a refrigerant circuit capable of changing the flow direction of a working fluid. For example, it may be provided in a refrigerant circuit capable of switching between a heating operation and cooling operation with four-way valves.

<First Compressor>

Figure 2:
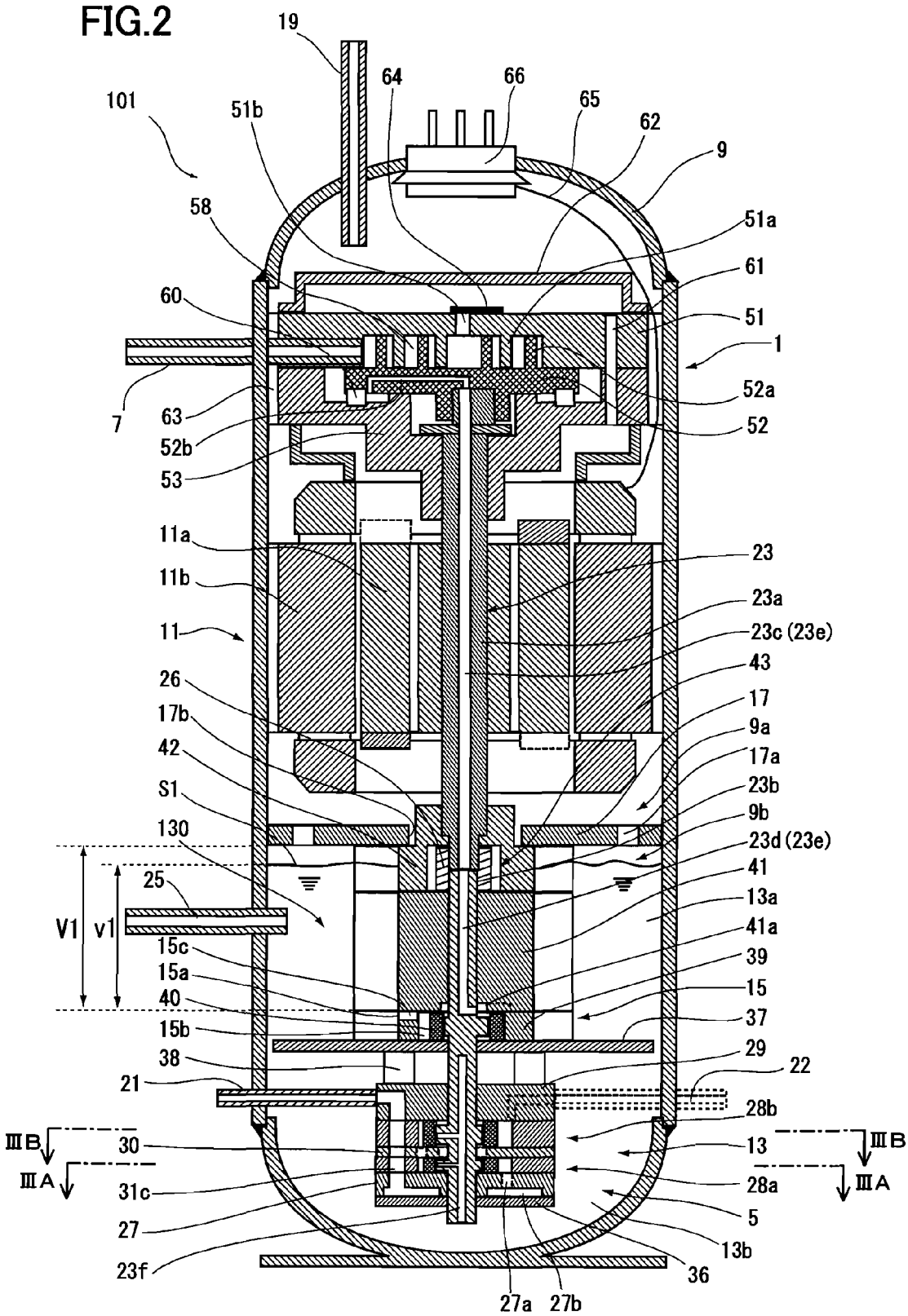
FIG. 2 is a vertical sectional view showing a first compressor according to the first embodiment.

Next, the first compressor 101 is described in detail referring to FIG. 2.

The first closed casing 9 has a cylindrical shape extending in the vertical direction with its upper end and lower end being closed. The first closed casing 9 includes a first oil sump 13 formed in its bottom by allowing oil to pool, and the internal space of the first closed casing 9 above the first oil sump 13 is filled with the working fluid discharged from the first compression mechanism 1. The expansion mechanism 5 is disposed at a lower position inside the first closed casing 9 and immersed in the first oil sump 13. The first compression mechanism 1 is disposed at an upper position inside the first closed casing 9. The first shaft 23 extends in the vertical direction across from the first compression mechanism 1 to the expansion mechanism 5. Further, the first motor 11, a first oil-flow suppressing plate (first suppressing member) 17, a first oil pump 15 and a heat-insulating member 37 are disposed from top to bottom in this order between the first compression mechanism 1 and the expansion mechanism 5 inside the first closed casing 9.

Inside the first shaft 23, a first oil-supply passage 23*e* extending above the first oil sump 13 for introducing oil from the first oil pump 15 to the first compression mechanism 1 is formed. More specifically, the first shaft 23 includes an upper shaft 23*a* and a lower shaft 23*b*, and the shafts 23*a* and 23*b* are coupled to each other at a slightly lower position than the first oil-flow suppressing plate 17 by a coupling member 26. The first oil-supply passage 23*e* is composed of an upper oil channel 23*c* axially passing through the upper shaft 23*a* and a lower oil channel 23*d* extending downward from the upper end surface of the lower shaft 23*b* and opening on the side of the lower shaft 23*b*. Inside the lower shaft 23*b*, an oil-supply passage 23*f* for the expansion mechanism that introduces oil from the lower end surface of the lower portion shaft 23*b* to each sliding portion of the expansion mechanism 5 is formed.

The compression mechanism 1 is fixed to the internal surface of the first closed casing 9 by welding or the like. In this embodiment, the compression mechanism 1 is a scroll type. However, the type of the compression mechanism 1 is not limited thereto in any way. For example, it is possible to use a rotary-type compressor or the like.

More specifically, the compression mechanism 1 includes a stationary scroll 51, a movable scroll 52 axially facing the stationary scroll 51 and a bearing member 53 supporting the upper part of the upper shaft 23*a*. A lap 51*a* and a lap 52*a* in a spiral shape (such as an involute shape) meshing with each other are formed respectively in the stationary scroll 51 and the movable scroll 52, and a compression chamber 58 in a spiral shape is defined between the lap 51*a* and the 52*a*. In the center of the stationary scroll 51, a discharge port 51*b* adapted to be opened and closed by a reed valve 64 is provided. An Oldham ring 60 for preventing the movable scroll 52 from rotating is disposed below the movable scroll 52. At the upper end of the upper shaft 23*a*, an eccentric portion is formed, and the movable scroll 52 fits into the eccentric portion. Therefore, the movable scroll 52 pivots in an eccentric manner with respect to the axial center of the upper shaft 23*a*. Further, in the movable scroll 52, an oil-distribution passage 52*b* introducing oil supplied from the first oil-supply passage 23*e* to each sliding portion is provided.

Over the stationary scroll 51, a cover 62 is provided. At a position covered by the cover 62 in the stationary scroll 51 and the bearing member 53, a discharge passage 61 is formed and passes through these in the vertical direction. Further, at a position outside the cover 62 in the stationary scroll 51 and bearing member 53, a flow passage 63 is formed passing through these in the vertical direction. Such a configuration allows the working fluid compressed in the compression chamber 58 to be discharged first into the space inside the cover 62 through the discharge port 51*b*, and thereafter discharged below the first compression mechanism 1 through the discharge passage 61. Then, the working fluid below the first compression mechanism 1 is introduced above the first compression mechanism 1 through the flow passage 63.

The first suction pipe 7 is connected to the stationary scroll 51, passing through a lateral part of the first closed casing 9. With this configuration, the first suction pipe 7 is connected to the suction side of the first compression mechanism 1. The first discharge pipe 19 passes through the upper part of the first closed casing 9, and the lower end of the first discharge pipe 19 opens into the upper space of the first compression mechanism 1 inside the first closed casing 9.

The first motor 11 includes a rotor 11*a* fixed to the middle of the upper shaft 23*a* and a stator 11*b* disposed around the rotor 11*a*. The stator 11*b* is fixed to the internal surface of the first closed casing 9. The stator 11*b* is connected to a terminal 66 via a motor wiring 65. The first motor 11 rotates the upper shaft 23*a*, thereby allowing the first compression mechanism 1 to be driven.

The first oil-flow suppressing plate 17 is disposed so as to partition the space inside the first closed casing 9 horizontally, that is, partition it into an upper space 9*a* and a lower space 9*b* at a slightly upper position (during shutdown) than the first oil sump 13. In this embodiment, the first oil-flow suppressing plate 17 has a vertically flat disc shape having substantially the same diameter as the internal diameter of the first closed casing 9, and the periphery thereof is fixed to the internal surface of the first closed casing 9 by welding or the like. The first oil-flow suppressing plate 17 prevents the oil of the first oil sump 13 from flowing with the flow of the working fluid inside the first closed casing 9. Specifically, although the working fluid filling the upper space 9*a* forms a swirl flow due to the rotation of the rotor 11*a* of the first motor 11, the swirl flow is blocked by the first oil-flow suppressing plate 17 before reaching an oil level S1 of the first oil sump 13.

In this embodiment, the oil pump 15, the heat-insulating member 37 and the expansion mechanism 5 are fixed to the first closed casing 9 via the first oil-flow suppressing plate 17. However, for example, it also is possible to fix the heat-insulating member 37 or the after-mentioned upper bearing member 29 of the expansion mechanism 5 to the first closed casing 9, so as to fix the oil pump 15 and the first oil-flow suppressing plate 17 to the first closed casing 9 via it. In this case, the first oil-flow suppressing plate 17 may have a disc shape having a slightly smaller diameter than the internal diameter of the first closed casing 9, and the below-described oil-return passage may be defined by the gap between the periphery of the first oil-flow suppressing plate 17 and the internal surface of the first closed casing 9. However, in the configuration where the first oil-flow suppressing plate 17 is fixed directly to the first closed casing 9, assembly is facilitated.

In the periphery of the first oil-flow suppressing plate 17, a plurality of through holes 17*a* are provided, and these through holes 17*a* serve as an oil-return passage that allows oil to flow down from the upper space 9*a* to the lower space 9*b*. The number and shape of the through holes 17*a* can be selected appropriately. Further, at the center of the first oil-flow suppressing plate 17, a through hole 17*b* is provided. A bearing member 42 supporting the lower portion of the upper shaft 23*a* is mounted to the lower surface of the first oil-flow suppressing plate 17 so as to fit into the through hole 17*b*.

On the lower surface of the bearing member 42, an accommodation chamber 43 accommodating the coupling member 26 is provided. An intermediate member 41 vertically extending and having a particular cross-sectional shape is disposed below the bearing member 42. The lower shaft 23*b* passes through the center of the intermediate member 41, and the intermediate member 41 closes the accommodating chamber 43.

The first oil pump 15 is sandwiched between the intermediate member 41 and the heat-insulating member 37. In this embodiment, the first oil pump 15 is a rotary type. However, the type of the first oil pump 15 is not limited in any way, and a trochoid gear-type pump also can be used, for example.

Specifically, the first oil pump 15 includes a piston 40 fitting into an eccentric portion formed in the lower shaft 23*b* to move eccentrically and a housing (cylinder) 39 accommodating the piston 40. A crescent-shaped working chamber 15*b* is formed between the piston 40 and the housing 39, and the working chamber 15*b* is closed by the intermediate member 41 from above, and closed by the heat-insulating member 37 from below. The housing 39 is provided with a suction passage 15*c* for communicating the working chamber 15*b* into the first oil sump 13, and the inlet of the suction passage 15*c* forms a first oil-suction opening 15*a*. Further, a guide passage 41*a* for introducing the oil discharged from the oil pump 15 to the inlet of the first oil-supply passage 23*e* is formed on the lower surface of the intermediate member 41. With such a configuration, when the first shaft 23 rotates, the oil of the first oil sump 13 is drawn through the first oil-suction opening 15*a* by the first oil pump 15 and thereafter discharged to the guide passage 41*a*, and then it is supplied to the first compression mechanism 1 through the guide passage 41*a* and the first oil-supply passage 23*e*.

Here, among the space of the first closed casing 9, the space from the first oil-flow suppressing plate 17 to the first oil-suction opening 15*a* in the vertical direction that is capable of being filled with oil is defined as a first available oil space 130, and the volumetric capacity thereof is defined as V1. That is, the volumetric capacity V1 of the first available oil space 130 is a volume obtained by subtracting, from a volumetric capacity from the first oil-flow suppressing plate 17 to the first oil-suction opening 15*a* inside the first closed casing 9 in the vertical direction, a volume occupied by the components of the first compressor 101 that face the internal surface of the first closed casing 9 in the pertinent area (which are the bearing member 42, the intermediate member 41 and the housing 39 of the oil pump 15, in this embodiment). Further, the volume of oil that is present practically in the first available oil space 130 is defined as v1.

The heat-insulating member 37 partitions the first oil sump 13 into an upper layer 13*a* and a lower layer 13*b* as well as regulating the flow of oil between the upper layer 13*a* and the lower layer 13*b*. In this embodiment, the heat-insulating member 37 has a vertically flat disc shape having a slightly smaller diameter than the internal diameter of the first closed casing 9, and a slight flow of oil is allowed through a gap formed between the heat-insulating member 37 and the internal surface of the first closed casing 9. The lower shaft 23*b* passes through the center of the heat-insulating member 37.

The heat-insulating member 37 is not limited as long as it serves as a partition between the upper layer 13*a* and the lower layer 13*b* and regulates the flow of oil therebetween, and the shape and structure thereof can be selected appropriately. For example, it also is possible that the diameter of the heat-insulating member 37 matches the internal diameter of the first closed casing 9 and the heat-insulating member 37 is provided with a through opening or a cut from an edge for allowing oil to flow. Alternatively, the heat-insulating member 37 may be formed by a plurality of components into a hollow shape (for example, a reel shape), so that oil can be held therein temporarily.

The expansion mechanism 5 is provided below the heat-insulating member 37, interposing a spacer 38 therebetween. The spacer 38 forms a space filled with the oil of the lower layer 13*b* between the heat-insulating member 37 and the expansion mechanism 5. The oil filling the space defined by the spacer 38 in itself acts as a heat insulator, and axially forms a thermal stratification.

In this embodiment, the expansion mechanism 5 is a two-stage rotary type. However, the type of the expansion mechanism 5 is not limited in any way. For example, it also is possible to use other types of expanders such as a single-stage rotary-type expander, a scroll-type expander and a sliding vane-type expander.

More specifically, the expander 5 includes a closing member 36, a lower bearing member 27, a first expansion portion 28*a*, an intermediate plate 30, a second expansion portion 28*b* and upper bearing member 29, which are disposed from bottom to top in this order. The second expansion portion 28*b* has a greater height than the first expansion portion 28*a*. In this embodiment, the suction pipe 21 on the expansion side and the discharge pipe 22 on the expansion side are connected to the upper bearing member 29 passing through the lateral part of the first closed casing 9.

Figure 3A:
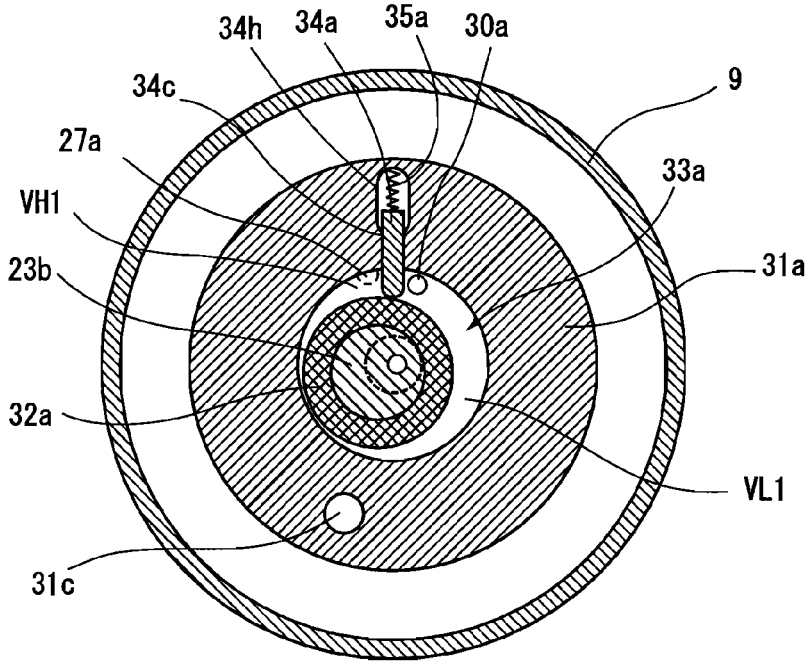
FIG. 3A is a horizontal sectional view taken along the line IIIA-IIIA.

As shown in FIG. 3A, the first expansion portion 28*a* includes a cylindrical piston 32*a* fitting into an eccentric portion formed in the lower shaft 23*b* and a substantially cylindrical cylinder 31*a* accommodating the piston 32*a*. A first fluid chamber 33*a* is defined between the inner peripheral surface of the cylinder 31*a* and the outer peripheral surface of the piston 32*a*. Further, a vane groove 34*c* extending in the radially outward direction is formed in the cylinder 31*a*, and a vane 34*a* is inserted slidably into the vane groove 34*c*. Furthermore, a back chamber 34*h* extending in the radially outward direction that communicates with the vane groove 34*c* is formed in the back (in the radially outward direction) of the vane 34*a* of the cylinder 31*a*. Inside the back chamber 34*h*, a spring 35*a* biasing the vane 34*a* toward the piston 32*a* is provided. The vane 34*a* partitions the first fluid chamber 33*a* into a fluid chamber VH1 on the high-pressure side and a fluid chamber VL1 on the low-pressure side.

Figure 3B:
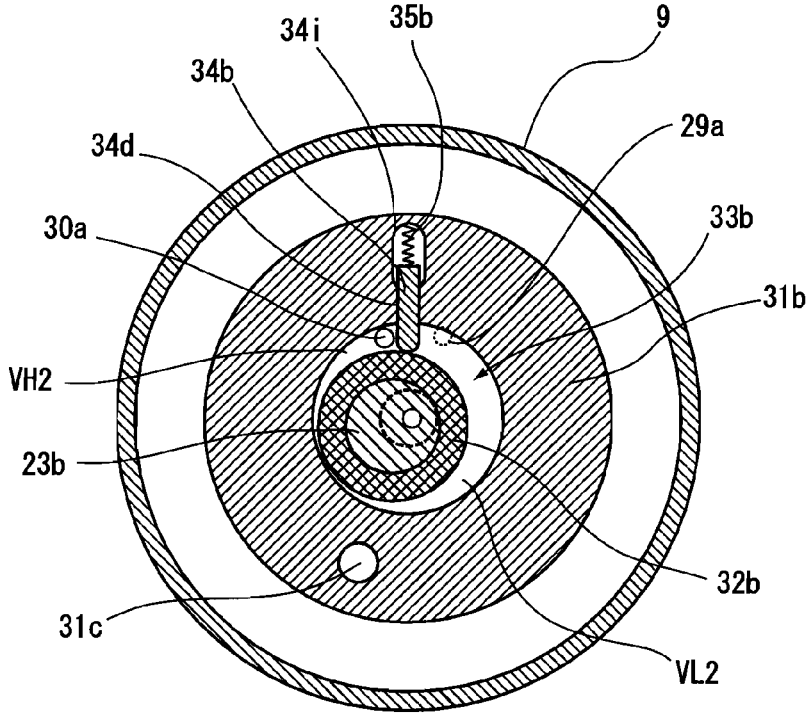
FIG. 3B is a horizontal sectional view taken along the line IIIB-IIIB in FIG. 2.

As shown in FIG. 3B, the second expansion portion 28*b* has almost the same configuration as the first expansion portion 28*a*. That is, the second expansion portion 28*b* includes a cylindrical piston 32*b* fitting into an eccentric portion formed in the lower shaft 23*b* and a substantially cylindrical cylinder 31*b* accommodating the piston 32*b*. A second fluid chamber 33*b* is defined between the inner peripheral surface of the cylinder 31*b* and the outer peripheral surface of the piston 32*b*. A vane groove 34*d* extending in the radially outward direction is formed also in the cylinder 31*b*, and a vane 34*b* is slidably inserted into the vane groove 34*d*. Furthermore, a back chamber 34*i* extending in the radially outward direction that communicates with the vane groove 34*d* is formed in the back of the vane 34*b* of the cylinder 31*b*. Inside the back chamber 34*i*, a spring 35*b* biasing the vane 34*b* toward the piston 32*b* is provided. The vane 34*b* partitions the second fluid chamber 33*b* into a fluid chamber VH2 on the high-pressure side and a fluid chamber VL2 on the low-pressure side.

Returning to FIG. 2, the lower bearing member 27 supports the lower shaft 23*b* and closes the first fluid chamber 33*a* from below. A pre-expansion fluid chamber 27*b* communicating with the suction pipe 21 on the expansion side through an introduction passage 31*c* is provided on the lower surface of the lower bearing member 27. The pre-expansion fluid chamber 27*b* is closed by the closing member 36. Further, the lower bearing member 27 is provided with a suction port 27*a* for allowing the working fluid to flow in from the pre-expansion fluid chamber 27*b* to the fluid chamber VH1 on the high-pressure side of the first expansion portion 28*a*.

The intermediate plate 30 closes the first fluid chamber 33*a* from above, and closes the second fluid chamber 33*b* from below. Further, a communication passage 30*a* communicating between the fluid chamber VL1 on the low-pressure side of the first expansion portion 28*a* and the fluid chamber VH2 on the high-pressure side of the second expansion portion 28*b* so as to constitute an expansion chamber is formed in the intermediate plate 30.

The upper bearing member 29 supports the lower shaft 23*b* and closes the second fluid chamber 33*b* from above. Further, the upper bearing member 29 is provided with a discharge port 29*a* for introducing the working fluid from the fluid chamber VL2 on the low-pressure side of the second expansion portion 28*b* to the discharge pipe 22 on the expansion side.

Next, the circulation of oil inside the first compressor 101 is described.

The oil in the upper layer 13*a* of the first oil sump 13 is supplied to the first compression mechanism 1 through the first oil-supply passage 23*e* by the first oil pump 15. On the way thereto, although the oil could leak from slight gaps between the coupling member 26 and the upper shaft 23*a* and between the coupling member 26 and the lower shaft 23*b* in the coupling portions with the upper shaft 23*a* and with the lower shaft 23*b*, the accommodation chamber 43 accommodating the coupling member 26 is closed by the bearing member 42 and the intermediate member 41, thereby allowing the oil to be supplied stably to the first compression mechanism 1. Moreover, the oil supplied to the first compression mechanism 1 is used for seal and lubrication between components, and thereafter a part of the oil is discharged through the discharge passage 61 together with the working fluid, and the rest flows down onto the upper end of the rotor 11*a* while lubricating the bearing member 53 and the upper shaft 23*a*. Thereafter, the oil discharged below the first compression mechanism 1 moves below the first motor 11 with the working fluid. The oil separated here from the working fluid by gravity and centrifugal force returns to the first oil sump 13 again through the through openings 17*a* of the first oil-flow suppressing plate 17. On the other hand, the oil that has not been separated from the working fluid is introduced above the first compression mechanism 1 through the flow passage 63 and the like and discharged through the first discharge pipe 19 to the first pipe 3*a* with the working fluid.

Meanwhile, oil is pumped from the lower layer 13*b* of the first oil sump 13 through the oil-supply passage 23*f* on the expansion mechanism side that is provided inside the lower shaft 23*b*, and thereby oil is supplied to the expansion mechanism 5. The oil supplied to the expansion mechanism 5 is used for seal and lubrication between components. At this time, a part of the oil inflows to the first fluid chamber 33*a* and the second fluid chamber 33*b* through gaps around the pistons 32*a* and 32*b* and vanes 34*a* and 34*b*. The oil that has flowed in is discharged through the discharge pipe 22 on the expansion side to the third pipe 3*c*.

<Second Compressor>

Figure 4:
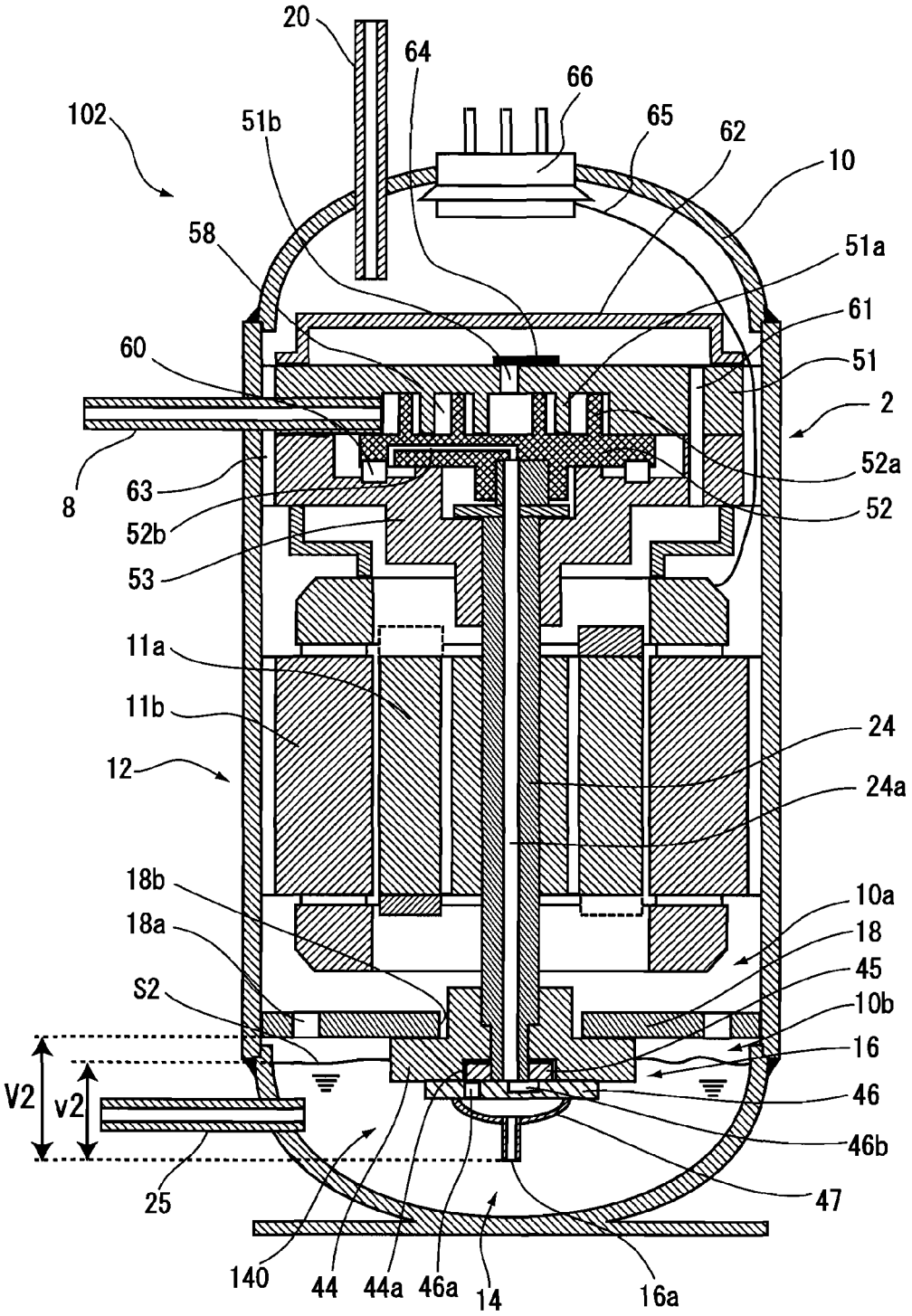
FIG. 4 is a vertical sectional view showing a second compressor according to the first embodiment.

Next, the second compressor 102 is described in detail referring to FIG. 4.

The second closed casing 10 has a cylindrical shape extending in the vertical direction with its upper end and lower end being closed. In this embodiment, the second closed casing 10 has the same internal diameter as the first closed casing 9. The first closed casing 10 includes a second oil sump 14 formed in its bottom by allowing oil to pool, and the internal space of the second closed casing 10 above the second oil sump 14 is filled with the working fluid discharged from the second compression mechanism 2. The second compression mechanism 2, the second motor 12, a second oil-flow suppressing plate (second suppressing member) 18 and a second oil pump 16 are disposed from top to bottom in this order inside the second closed casing 10. The second shaft 24 extends in the vertical direction across from the second compression mechanism 2 to the second oil pump 16.

Inside the second shaft 24, a second oil-supply passage 24*a* axially passing through the second shaft 24 for introducing oil from the second oil pump 16 to the second compression mechanism 2 is formed.

In this embodiment, the same compression mechanism of the scroll-type as the first compression mechanism 1 is used as the second compression mechanism 2. Further, the second motor 12 is the same as the first motor 11. Therefore, concerning the configuration of the second compression mechanism 2 and the second motor 12, the same members as those in the first compression mechanism 1 and the first motor 11 are indicated with the same numerals, and the descriptions thereof are omitted.

The second oil-flow suppressing plate 18 is disposed so as to partition the space inside the second closed casing 10 horizontally, that is, partition it into an upper space 10*a* and a lower space 10*b* at a slightly upper position (during shutdown) than the second oil sump 14. In this embodiment, the second oil-flow suppressing plate 18 has a vertically flat disc shape having substantially the same diameter as the internal diameter of the second closed casing 10, and the periphery thereof is fixed to the internal surface of the second closed casing 10 by welding or the like. The second oil-flow suppressing plate 18 prevents the oil of the second oil sump 14 from flowing with the flow of the working fluid inside the second closed casing 10. Specifically, although the working fluid filling the upper space 10*a* forms a swirl flow due to the rotation of the rotor 11*a* of the second motor 12, the swirl flow is blocked by the second oil-flow suppressing plate 18 before reaching an oil level S2 of the second oil sump 14.

In the periphery of the second oil-flow suppressing plate 18, a plurality of through holes 18*a* are provided, and these through holes 18*a* serve as an oil-return passage that allows oil to flow down from the upper space 10*a* to the lower space 10*b*. The number and shape of the through holes 18*a* can be selected appropriately. Further, at the center of the second oil-flow suppressing plate 18, a through hole 18*b* is provided. A bearing member 44 supporting the lower portion of the second shaft 24 is mounted to the lower surface of the second oil-flow suppressing plate 18 so as to fit into the through hole 18*b*.

The second oil pump 16 according to this embodiment includes an oil gear pump 45 and an oil channel plate 46. The oil gear pump 45 is disposed inside a concave portion 44*a* provided on the lower surface of the bearing member 44 and is mounted to the lower end of the second shaft 24. The oil channel plate 46 is mounted to the bearing member 44 so as to close the concave portion 44*a*. The oil channel plate 46 is formed with a suction passage 46*a* passing through the oil channel plate 46 for introducing oil to the working chamber of the oil gear pump 45 and a discharge passage 46*b* for introducing the oil from the working chamber of the oil gear pump 45 to the second oil-supply passage 24*a*.

Further, in this embodiment, a funnel-shaped oil strainer 47 is disposed below the oil channel plate 46, and the inlet of the oil strainer 47 forms a second oil-suction opening 16*a*. However, the oil strainer 47 can be omitted. In this case, the lower end of the suction passage 46*a* of the oil channel plate 46 forms the second oil-suction opening 16*a*. Further, the type of the second oil pump 16 is not limited in any way, and it also is possible to use the same pump of the rotary type as the first oil pump 15, for example.

Here, among the space of the second closed casing 10, a space from the second oil-flow suppressing plate 18 to the second oil-suction opening 16*a* in the vertical direction that is capable of being filled with oil is defined as a second available oil space 140, and the volumetric capacity thereof is defined as V2. That is, the volumetric capacity V2 of the second available oil space 140 is a volume obtained by subtracting, from a volumetric capacity from the second oil-flow suppressing plate 18 to the second oil-suction opening 16*a* inside the second closed casing 10 in the vertical direction, a volume occupied by the components of the second compressor 102 that face the internal surface of the second closed casing 10 in the pertinent area (which are the bearing member 44, the oil channel plate 46 of the oil pump 16 and the strainer 47, in this embodiment). Further, the volume of oil that is present practically in the second available oil space 140 is defined as v2.

Next, the circulation of oil inside the second compressor 102 is described.

When the second shaft 24 rotates, the oil of the second oil sump 14 is drawn through the second oil-suction opening 16*a* by the second oil pump 16 and thereafter discharged to the second oil-supply passage 24*a*, and then it is supplied to the second compression mechanism 2 through the second oil-supply passage 24*a*. The state of the subsequent oil flow is the same as that in the compression mechanism 1 of the first compressor 101.

<Relationship Between First Compressor and Second Compressor>

Next, the relationship between the first compressor 101 and the second compressor 102 is described.

The first oil-flow suppressing plate 17 and the second oil-flow suppressing plate 18 are located at substantially the same height with respect to the same horizontal plane and aligned in the horizontal direction. Further, the first oil sump 13 and the second oil sump 14 communicate with each other through the oil-equalizing pipe 25. The oil-equalizing pipe 25 is provided with an oil-equalizing pipe valve 25*a*, which allows the flow of oil between the first oil sump 13 and the second oil sump 14 to be limited or completely inhibited by being opened or closed. If the oil-equalizing pipe valve 25*a* is opened during shutdown, the oil level S1 of the first oil sump 13 and the oil level S2 of the second oil sump 14 are allowed to be maintained on the same horizontal plane. That is, a distance from the lower surface of the first oil-flow suppressing plate 17 to the oil level S1 of the first oil sump 13 and a distance from the lower surface of the second oil-flow suppressing plate 18 to the oil level S2 of the second oil sump 14 are equalized.

Further, the volumetric capacity V1 of the first available oil space 130 inside the first closed casing 9 is set larger than the volumetric capacity V2 of the second available oil space 140 inside the second closed casing 10. Specifically, the first oil-suction opening 15*a* is located below the second oil-suction opening 16*a*.

Here, the fluid machine 105 preferably is configured in such a manner that the volumetric capacity below the oil level S1 of the first oil sump 13 among the first available oil space 130 is larger than the volumetric capacity above the oil level S2 of the second oil sump 14 among the second available oil space 130 when the oil level S1 of the first oil sump 13 and the oil level S2 of the second oil sump 14 are maintained on the same horizontal plane by the oil-equalizing pipe 25. This is because, in such a configuration, even if the oil inside the first compressor 101 moves into the second compressor 102 to the extent of filling up the second available oil space 140, oil remains in the first available oil space 130, that is, above the first oil-suction opening 15*a*.

Figure 5:
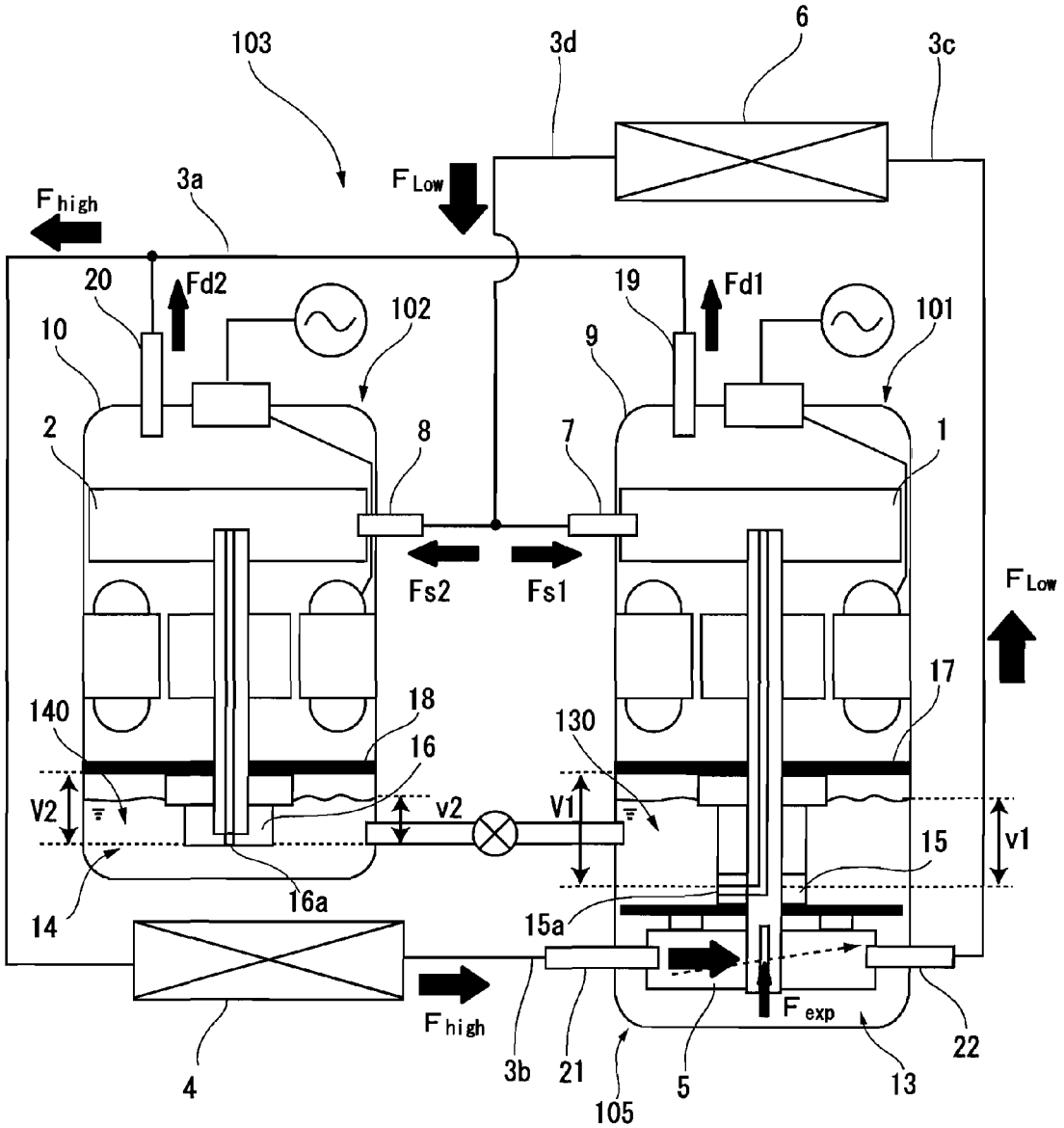
FIG. 5 is a phase diagram indicating the oil flow immediately after the start of the refrigeration cycle apparatus indicated in FIG. 1.
Figure 6A:
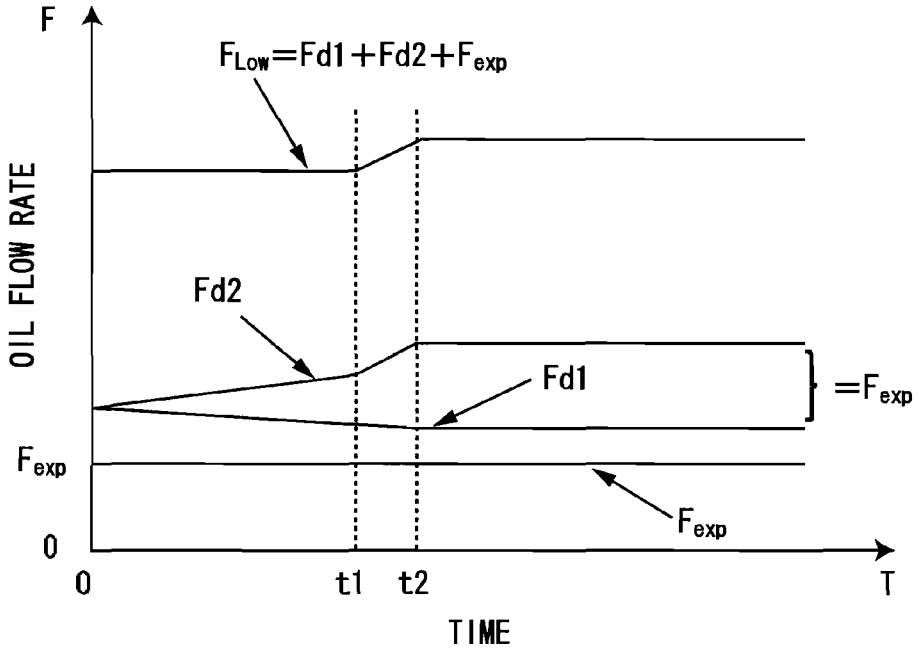
FIG. 6A is a graph indicating the variation of the oil flow rate with operation time in the fluid machine.
Figure 6B:
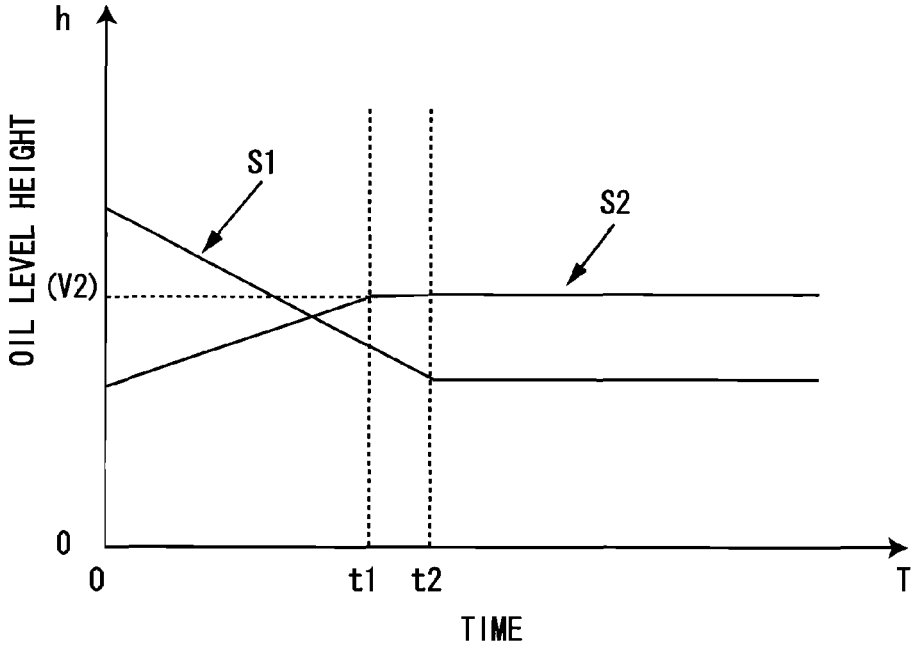
FIG. 6B is a graph indicating the variation of the oil level height with operation time in the fluid machine.
Figure 7:
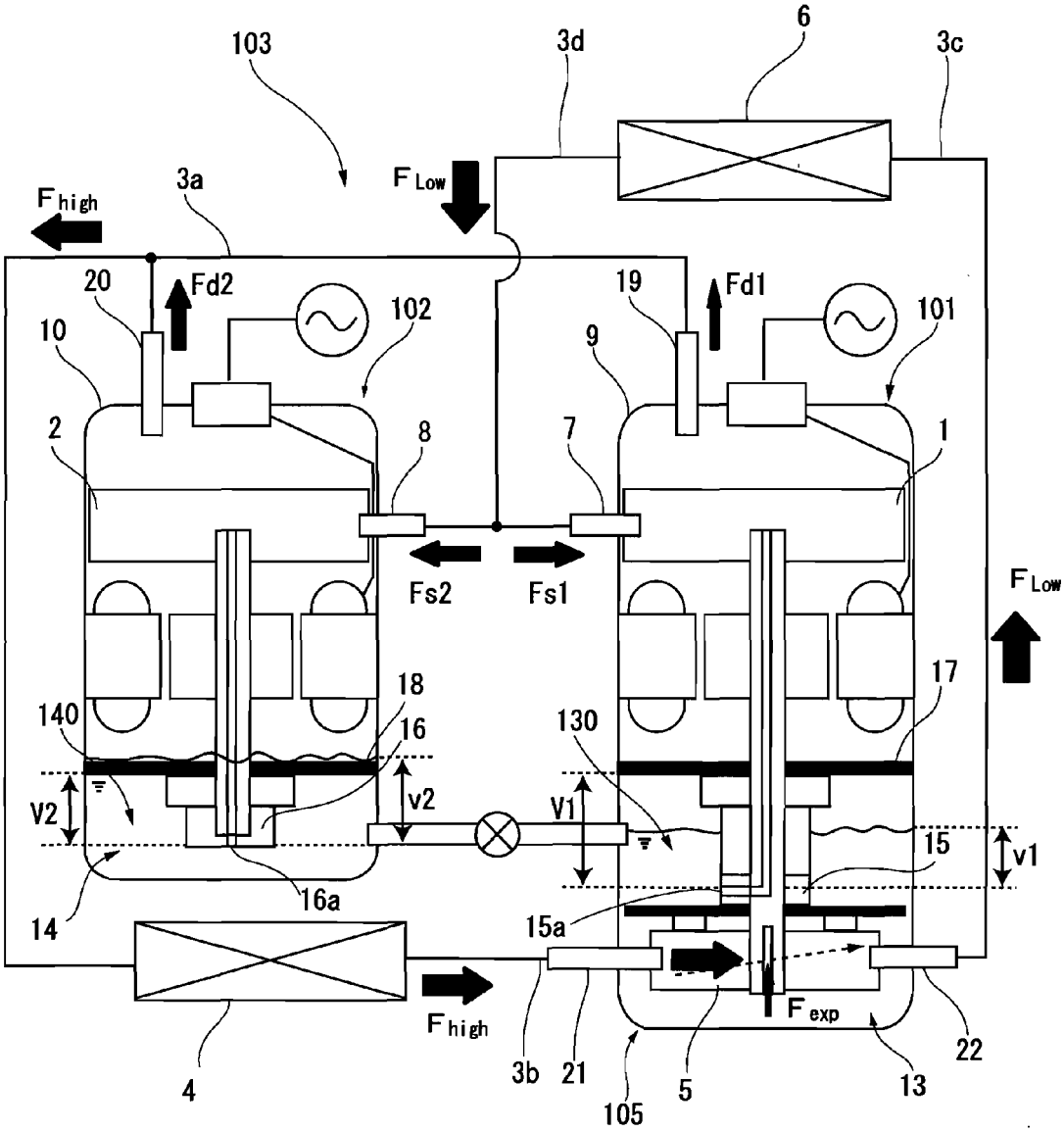
FIG. 7 is a phase diagram indicating the oil flow in a steady state of the refrigeration cycle apparatus indicated in FIG. 1.
Figure 8:
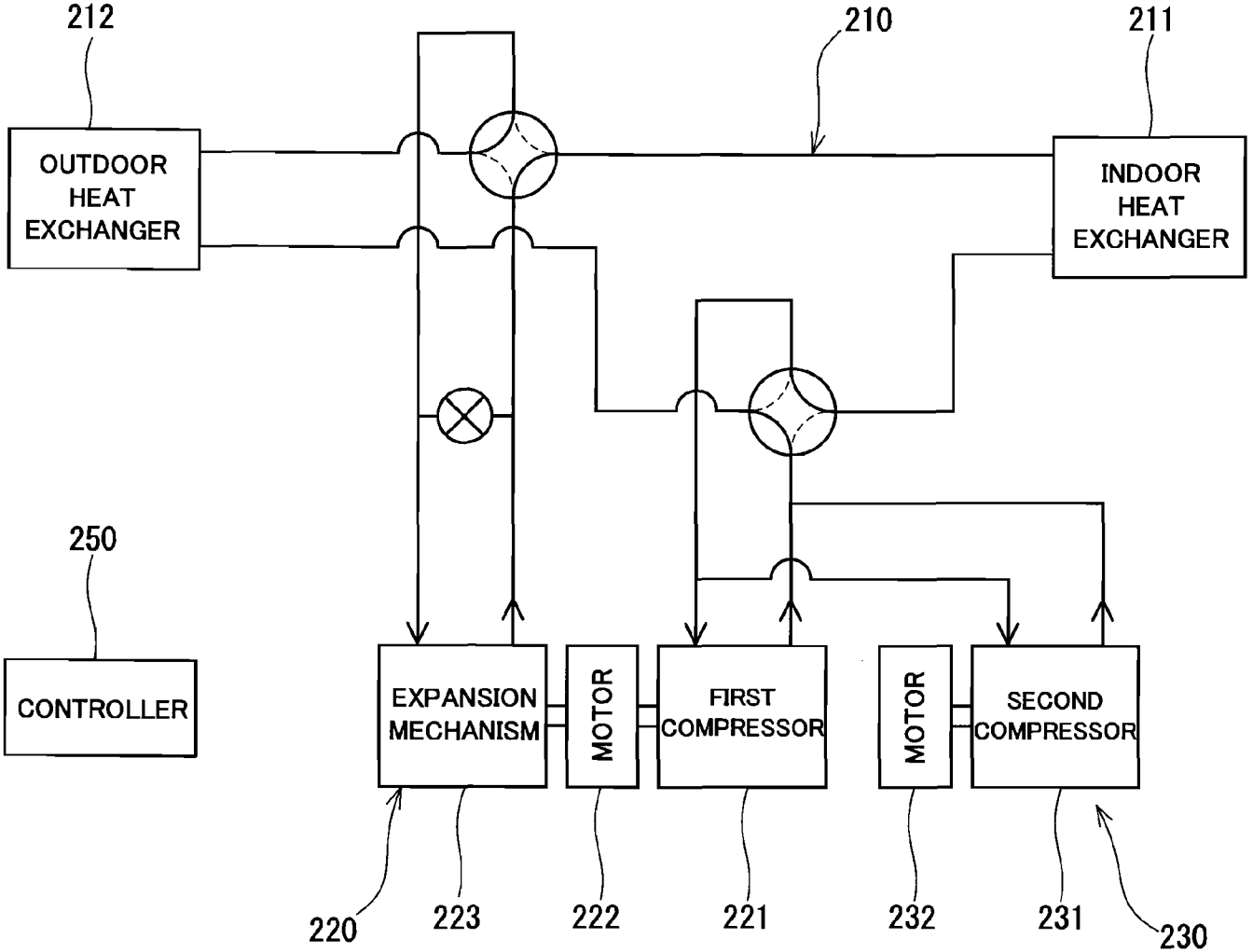
FIG. 8 is a configuration diagram indicating a conventional refrigeration cycle apparatus.
Figure 9:
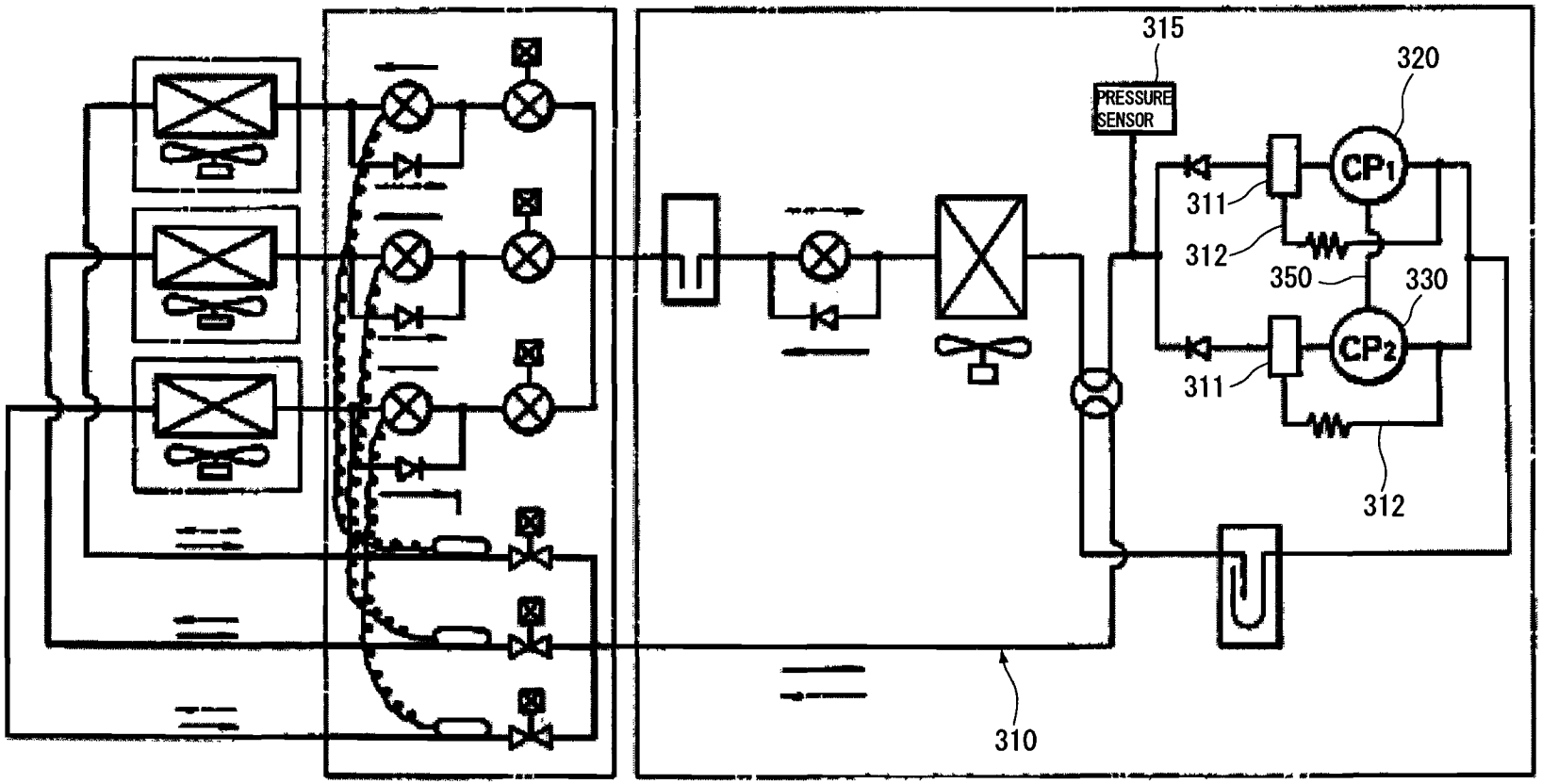
FIG. 9 is a configuration diagram indicating another conventional refrigeration cycle apparatus.
Figure 10:
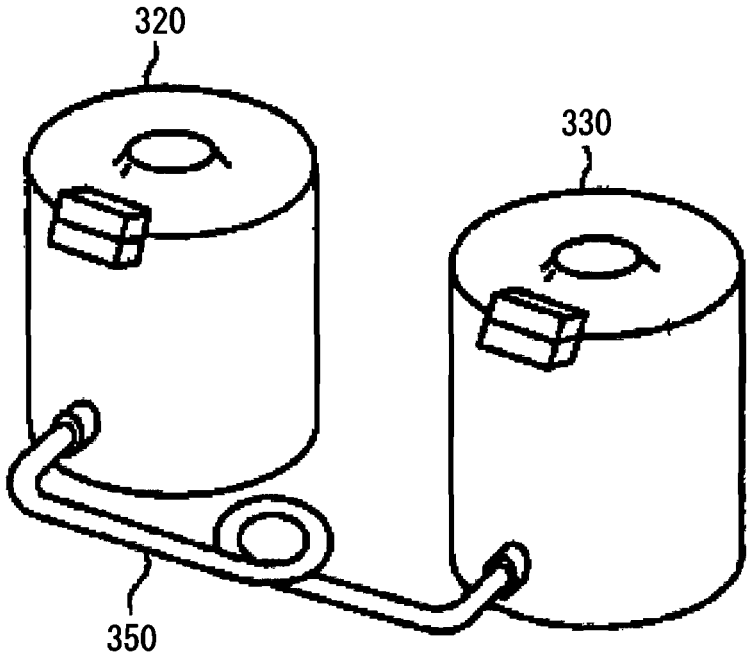
FIG. 10 is a perspective view showing compressors and an oil-equalizing pipe in the refrigeration cycle apparatus indicated in FIG. 9.

Next, the relationship between the oil flow state of the refrigeration cycle apparatus as a whole in operation and each variation of oil level height in the first oil sump 13 of the first compressor 101 and the second oil sump 14 of the second compressor 102 are described using FIG. 5, FIG. 6A, FIG. 6B and FIG. 7. FIG. 5 is a diagram indicating the oil flow state and the oil level height immediately after the start of the refrigeration cycle apparatus and FIG. 7 is a diagram indicating the oil flow state and the oil level height in steady operation. FIG. 6A is a graph indicating the time from the start of operation to the steady state and the variation of the oil flow rate at each point, and FIG. 6B is a graph indicating the time from the start of operation to the steady state and the variation of the oil level height at each time.

As indicated in FIG. 5, oil outflows from the first compressor 101 and the second compressor 102 to the first pipe 3*a* with the discharged working fluid. The oil mass flow rate from the first discharge pipe 19 at that time is taken as Fd1, and the oil mass flow rate from the second discharge pipe 20 at that time is taken as Fd2. The oil that has outflowed thereafter merges in the first pipe 3*a*. Assuming that the oil mass flow rate at that time is $F_{high}$, the relationship is expressed as $F_{high}$=Fd1+Fd2. On the other hand, in the expansion mechanism 5 of the first compressor 101, oil inflows to the inside of the expansion mechanism 5, as mentioned above, while performing lubrication and sealing between components, and thereafter it merges with the working fluid that is inflowing to the expansion mechanism 5 as well as oil flowing with the working fluid. Then, the oil is discharged through the discharge pipe 22 on the expansion side to the third pipe 3*c*. Assuming that the oil mass flow rate from the expansion mechanism 5 at that time is taken as $F_{exp}$ and the oil mass flow rate discharged through the pipe 22 on the expansion side at that time is taken as $F_{low}$, the relationship is expressed as $F_{low}=F_{high}+F_{exp}$. Thereafter, oil returning through the evaporator 6 flows separately to the first suction pipe 7 and the second suction pipe 8. The oil mass flow rate in the first suction pipe 7 at that time is taken as Fs1, the oil mass flow rate in the second suction pipe 8 at that time is taken as Fs2. Here, in the description of this embodiment, assuming that the rotation speeds of the first compressor 101 and the second compressor 102 are the same and oil is divided equally into two in the fourth pipe 3*d*, the relationship of the oil mass flow rate is expressed as Fs1=Fs2=$F_{low}/2$. Further, at the time of the start of operation, the distance from the first oil-flow suppressing plate 17 to the oil level S1 of the first oil sump 13 and the distance from the second oil-flow suppressing plate 18 to the oil level S2 of the second oil sump 14 are equal, and the compression mechanisms of the same type operate at the same rotation. Therefore, the relationship between the oil mass flow rate Fd1 from the first discharge pipe 19 and the oil mass flow rate Fd2 from the second discharge pipe 20 at the time of the start of operation is expressed as Fd1=Fd2=$F_{high}/2$.

Here, focusing on Fs2 and using Fd2, an expression derived from the above-mentioned relationship is given as follows:

$$Fs2=F_{low}/2=(F_{high}+F_{exp})/2=Fd2+F_{exp}/2.$$

That is, Fd2<Fs2, and this amount of difference ($F_{exp}/2$) remains inside the second closed casing 10. Eventually the volume v2 of oil inside the second available oil space 140 increases, and the oil level S2 of the second oil sump 14 increases. Conversely, oil outflows from the first closed casing 9 by the above-described amount of the difference ($F_{exp}/2$). Eventually the volume v1 of oil inside the first available oil space 130 decreases, and the oil level S1 of the first oil sump 13 decreases.

Next, the state in transition to a steady state is described. As aforementioned, at the time of the start of operation, the oil level S2 of the second oil sump 14 increases and, in contrast, the oil level S1 of the first oil sump 13 decreases according to the balance of the oil mass flow rate. When the oil level height increases, the space inside the closed casing for separation between the working fluid and oil is reduced, and the distance between the flow of the working fluid and the oil level in the lower space of the closed casing is shortened. As a result, the oil flow rate to be discharged from the closed casing increases. That is, the oil flow rate Fd2 to be discharged from the second compressor 102 with a tendency of an increase of the oil level S2 increases with time. Conversely, the oil flow rate Fd1 to be discharged from the first compressor 101 with a tendency of a decrease of the oil level S1 decreases with time. In this regard, the oil flow rate $F_{exp}$ to be consumed by the expansion mechanism 5 depends only on the rotation speed, and thus has no relationship with the oil level height. Therefore, it is constant regardless of time.

After time has elapsed further, the oil level height of the second oil sump 14 becomes equal to the height of the second oil-flow suppressing plate 18 (T=t1, V2=v2), and then the oil level S2 overflows the second oil-flow suppressing plate 18, so as to be affected directly by the flow of the working fluid in the lower part of the second closed casing 10. At this time, the subsequent increase of the oil level height suddenly slows down, and the oil flow rate Fd2 to be discharged suddenly increases, instead. At the time when the difference between the oil flow rate Fd1 to be discharged and the oil flow rate Fd2 to be discharged is equal to the oil flow rate $F_{exp}$ to be consumed by the expansion mechanism 5 (Fd2−Fd1=$F_{exp}$), the variation of the oil level height disappears so as to be a steady state (T=t2). The above-mentioned state is expressed as follows:

$$Fs2=(F_{high}+F_{exp})/2=(Fd1+Fd2+F_{exp})/2=Fd2.$$

The oil flow Fs2 drawn into the second compressor 102 and the oil flow rate Fd2 discharged therefrom are equalized, and the variation of the oil level height disappears.

As described above, according to this embodiment, the volumetric capacity V1 of the first available oil space 130 in the first compressor 101 is set larger than the volumetric capacity V2 of the second available oil space 140 in the second compressor 102. Therefore, even if the oil level S1 of the first oil sump 13 decreases in transition to a state of steady operation, it is possible to maintain a sufficient amount of oil above the first oil-suction opening 15*a*, thus achieving high reliability. As another solution for the above-mentioned problems, a method of significantly increasing the amount of oil to be stored in each compressor for accepting the imbalance of oil between a plurality of compressors also may be conceivable. However, if the amount of oil to be stored is increased, the amount of oil to be discharged from the compressor increases. Such oil may adhere to the inner wall of a heat exchanger inside a refrigeration cycle apparatus, thereby preventing heat conduction, or form an oil layer on a pipe wall inside a refrigerant pipe, thereby increasing the pressure loss in the pipe due to the reduction of the flow passage area in the pipe, so that the power to be recovered in the expansion mechanism 5 is reduced. For such reasons, a considerable decrease in efficiency of the refrigeration cycle apparatus may be caused, and thus the method is not preferable.

Further, according to this embodiment, the closed casings 9 and 10 having the same internal diameter are used for the first compressor 101 and the second compressor 102, and the distance from the first oil-flow suppressing plate 17 to the first oil-suction opening 15*a* is set longer than the distance from the second oil-flow suppressing plate 18 to the second oil-suction opening 16*a*. Consequently, the volumetric capacity V1 of the first available oil space 130 can be set as described above with a relatively simple and easy configuration. In addition, since closed casings having the same internal diameter and the same compression mechanisms corresponding to them can be used, reductions in component cost and production cost are feasible.

Further, according to this embodiment, the first compressor 101 and the second compressor 102 are coupled by the oil-equalizing pipe 25, and thus it is possible to eliminate the imbalance between the oil sump 13 and the oil sump 14 by opening the oil-equalizing pipe valve 25*a* during shutdown. It should be noted that the oil-equalizing pipe valve 25*a* is not necessarily closed during operation, and it may be slightly opened.

Further, according to this embodiment, since the first oil-flow suppressing plate 17 and the second oil-flow suppressing plate 18 are aligned in the horizontal direction, the distances between the oil levels S1 and S2 and the oil-flow suppressing plates 17 and 18 in the compressors 101 and 102 can be equalized during equalization of oil. With this configuration, during the equalization of oil, the distance from the oil level S1 of the first oil sump 13 to the first oil-suction opening 15*a* can be ensured to be longer than the distance from the oil level S2 of the second oil sump 14 to the second oil-suction opening 16*a*, and thus reliability is improved further.

Further, according to this embodiment, the expansion mechanism 5 of the two-stage rotary type is used. The expansion mechanism of the two-stage rotary type has a feature that the oil consumption thereof is high while having high efficiency compared to that of the single-stage rotary type. In this embodiment, use of the expansion mechanism of the two-stage rotary type causes no problem of high oil consumption, and it is possible to achieve highly efficient power recovery, taking advantage of the two-stage rotary system while ensuring high reliability.

Further, according to this embodiment, $CO_2$ is used as the working fluid. $CO_2$ has a high specific gravity compared to other fluorocarbon refrigerants and has a high effect of stirring oil in a closed casing and carrying it out of the closed casing. According to this embodiment, even if refrigerant has a high specific gravity, high reliability can be ensured.

Modified Examples

The first compressor 101 and the second compressor 102 have the same rotation speed in the above embodiments. However, it is needless to say that a similar effect can be achieved even in the case of different rotation speeds.

Further, even in the case without the oil-equalizing pipe 25, there is no particular problem, because oil is merely maintained in an unbalanced state during shutdown as indicated in FIG. 7. Thus, it is possible to omit the oil-equalizing pipe 25. However, in the case with the oil-equalizing pipe 25, the oil amount of each of the first compressor 101 and the second compressor 102 can be balanced during shutdown, as mentioned above.

Further, a configuration in which the first closed casing 9 and the second closed casing 10 have the same internal diameter mainly is described in the above-described embodiments. However, it is needless to say that even if closed casings having different internal diameters are used, a similar effect can be achieved as long as the volumetric capacity V1 of the first available oil space 130 in the first compressor 101 is set larger than the volumetric capacity V2 of the second available oil space 140 in the second compressor 102.

Further, it also is possible to use the first oil-flow suppressing plate 17 integrated with the bearing member 42 as a first suppressing member. In the case of using such a first suppressing member having a level difference on its lower surface, the first available oil space 130 is defined from the highest portion in the lower surface of the first suppressing member to the first oil-suction opening 15*a*. Similarly, it also is possible to use the second oil-flow suppressing plate 18 integrated with the bearing member 44 as a second suppressing member. In the case of using such a second suppressing member having a level difference on its lower surface, the second available oil space 140 is defined from the highest portion in the lower surface of the second suppressing member to the second oil-suction opening 16*a*.

Further, the first oil pump 15 may be provided at a lower end of the first shaft 23, and may be configured in such a manner that oil of the first oil sump 13 is supplied to both of the expansion mechanism 5 and the first compression mechanism 1 through the first oil-supply passage provided in the first shaft. In this case, it also is possible to constitute the first suppressing member using the upper bearing member 29 by locating the upper bearing member 29 of the expansion mechanism 5 above the oil level S1 of the first oil sump 13 as well as extending it to the internal surface of the first closed casing 9. However, as are the cases of the above-described embodiments, if the first oil pump 15 and the first oil-suction opening 15*a* are located above the expansion mechanism 5, it is possible to prevent the oil that has passed through the compression mechanism 1 so as to have a relatively high temperature from inflowing to the periphery of the expansion mechanism 5, and thus to suppress heat transfer from the compression mechanism 1 to the expansion mechanism 5 via oil.

Further, in the above embodiments, the same oil sump (oil is continuous) is used as an oil supply source for the first compression mechanism 1 and the expansion mechanism 5, however, even if the oil sump is partitioned by a member or the like into a plurality of oil sumps, it is possible to obtain a similar effect regardless of whether or not the oil sump is continuous, as long as the oil sump for the expansion mechanism 5 is configured not to be exhausted before the oil sump for the first compression mechanism 1.

Further, the expansion mechanism 5 is disposed below the first compression mechanism 1 in the above embodiments. However, it is needless to say that a similar effect can be obtained even if the expansion mechanism 5 is present above the first compressor 1. For example, in the case where the compression mechanism 1 is disposed at a lower position inside the first closed casing 9, the bearing member 53 of the compression mechanism 1 may constitute a first suppressing member. Further, the position of the first motor 11 also does not matter, and even in the case where the first compression mechanism 1 and the expansion mechanism 5 are present below the first motor 11, a similar effect can be obtained.

Further, the second compression mechanism 2 and the second motor 12 may be disposed upside down in the second compressor 101.

Furthermore, it is needless to say that even in the case where a horizontal-type compressor in which the first shaft 23 extends in the horizontal direction is used as the first compressor 101 in this embodiment instead of the vertical-type compressor in which the first shaft 23 extends in the vertical direction, a similar effect can be obtained as long as the first compression mechanism 1 and the expansion mechanism 5 are configured to share an oil sump. Similarly, the second compressor 102 may be a horizontal type.

INDUSTRIAL APPLICABILITY

The fluid machine of the present invention is useful as a device for recovering power by recovering the expansion energy of a working fluid in a refrigeration cycle.

The invention claimed is:

1. A fluid machine comprising:

a first closed casing including a first oil sump formed in its bottom and an internal space filled with a working fluid above the first oil sump;

a first motor disposed inside the first closed casing;

a first compression mechanism disposed inside the first closed casing for compressing the working fluid;

an expansion mechanism disposed inside the first closed casing for recovering power from the expanding working fluid;

a first shaft coupling the first motor, the first compression mechanism and the expansion mechanism;

a first oil pump for drawing oil of the first oil sump through a first oil-suction opening and supplying the oil to one or both of the first compression mechanism and the expansion mechanism through a first oil-supply passage that is provided in the first shaft and extends above the first oil sump;

a first suppressing member disposed so as to horizontally partition a space inside the first closed casing, for preventing the oil of the first oil sump from flowing with the flow of the working fluid inside the first closed casing;

a second closed casing including a second oil sump formed in its bottom and an internal space filled with a working fluid above the first oil sump;

a second motor disposed inside the second closed casing;

a second compression mechanism disposed inside the second closed casing for compressing the working fluid, the second compression mechanism being connected in parallel with the first compression mechanism in a working fluid circuit by interconnection between the first closed casing and the second closed casing through a pipe;

a second shaft coupling the second motor and the second compression mechanism;

a second oil pump for drawing oil of the second oil sump through a second oil-suction opening and supplying it to the second compression mechanism through a second oil-supply passage provided in the second shaft; and a second suppressing member disposed so as to horizontally partition a space inside the second closed casing, for preventing the oil of the second oil sump from flowing with the flow of the working fluid inside the second closed casing, wherein a volumetric capacity of a first available oil space from the first suppressing member to the first oil-suction opening inside the first closed casing is larger than a volumetric capacity of a second available oil space from the second suppressing member to the second oil-suction opening inside the second closed casing.

2. The fluid machine according to claim 1, further comprising an oil-equalizing pipe communicating the first oil sump and the second oil sump, wherein the fluid machine is configured in such a manner that a volumetric capacity below an oil level of the first oil sump among the first available oil space is larger than a volumetric capacity above an oil level of the second oil sump among the second available oil space when an oil level of the first oil sump and an oil level of the second oil sump are maintained on the same horizontal plane by the oil-equalizing pipe.

3. The fluid machine according to claim 1, wherein the first shaft and the second shaft extend in the vertical direction.

4. The fluid machine according to claim 3, wherein the first closed casing and the second closed casing each have a cylindrical shape extending in the vertical direction with its upper end and lower end being closed, the first closed casing and the second closed casing have the same internal diameter, and the first oil-suction opening is located below the second oil-suction opening.

5. The fluid machine according to claim 3, wherein the first suppressing member and the second suppressing member are located at substantially the same height with respect to the same horizontal plane.

6. The fluid machine according to claim 3, wherein the expansion mechanism is disposed below the first suppressing member, and the first compression mechanism and the first motor are disposed above the first suppressing member.

7. The fluid machine according to claim 6, wherein the first motor is located between the first compression mechanism and the first suppressing member.

8. The fluid machine according to claim 6, wherein the first oil pump is disposed between the first suppressing member and the expansion mechanism, the first oil-suction opening is located above the expansion mechanism, and the oil of the first oil sump is supplied to the first compression mechanism through the first oil-supply passage.

9. The fluid machine according to claim 8, further comprising a heat-insulating member disposed between the first oil pump and the expansion mechanism for partitioning the first oil sump into an upper layer and a lower layer as well as regulating the flow of oil between the upper layer and the lower layer.

10. The fluid machine according to claim 3, wherein the second compression mechanism, the second motor, the second suppressing member and the second oil pump are disposed from top to bottom in this order.

11. The fluid machine according to claim 1, wherein the first compression mechanism and the second compression mechanism each are a scroll type, and the expansion mechanism is a two-stage rotary type.

12. A refrigeration cycle apparatus comprising a working fluid circuit integrated with the fluid machine according to claim 1, wherein the first compression mechanism and the second compression mechanism are disposed in parallel in the working fluid circuit, and the working fluid circuit is filled with carbon dioxide as a working fluid.

* * * * *